US005411693A

United States Patent [19]

Wust, Jr.

[11] Patent Number: 5,411,693

[45] Date of Patent: May 2, 1995

[54] HIGH SPEED SPINNING OF MULTI-COMPONENT FIBERS WITH HIGH HOLE SURFACE DENSITY SPINNERETTES AND HIGH VELOCITY QUENCH

[75] Inventor: Carl J. Wust, Jr., Conyers, Ga.

[73] Assignee: Hercules Incorporated, Wilmington, Del.

[21] Appl. No.: 177,749

[22] Filed: Jan. 5, 1994

[51] Int. Cl.[6] ..... D01F 8/06

[52] U.S. Cl. ..... 264/171; 264/211.14

[58] Field of Search ..... 264/171, 211.14, 211.15, 264/211.16

[56] References Cited

U.S. PATENT DOCUMENTS

| | | | |
|---|---|---|---|
| 4,115,620 | 9/1978 | Gupta et al. | 428/374 |
| 4,381,274 | 4/1983 | Kessler et al. . | |
| 4,406,850 | 9/1983 | Hills | 264/171 |
| 4,439,487 | 3/1984 | Jennings . | |
| 4,445,833 | 5/1984 | Moriki et al. . | |
| 4,713,291 | 12/1987 | Sasaki et al. . | |
| 4,738,607 | 4/1988 | Nakajima et al. . | |
| 4,798,757 | 1/1989 | Modrak et al. | 428/198 |
| 4,868,031 | 9/1989 | Modrak et al. | 428/198 |
| 4,938,832 | 7/1990 | Schmalz . | |
| 5,162,074 | 11/1992 | Hills . | |
| 5,281,378 | 1/1994 | Kozulla | 264/83 |
| 5,318,735 | 6/1994 | Kozulla | 264/83 |

FOREIGN PATENT DOCUMENTS

| | | |
|---|---|---|
| 2120103 | 10/1994 | Canada . |
| 2120104 | 10/1994 | Canada . |
| 2120105 | 10/1994 | Canada . |
| 486158 | 5/1992 | European Pat. Off. . |
| 552013 | 7/1993 | European Pat. Off. . |
| 89/02938 | 4/1989 | WIPO . |

OTHER PUBLICATIONS

Automatik, an undated Equipment Description Brochure.

Cooke, *Bicomponent Fibers A Review of the Literature*, pp. 1–33, Dec. 1993, Princeton, N.J.

*Primary Examiner*—Leo B. Tentoni

*Attorney, Agent, or Firm*—Mark D. Kuller

[57] ABSTRACT

Process and apparatus for high speed spinning of multicomponent polymer filaments by providing a high face velocity quench unit near the lower surface of one or more high hole surface density spinnerettes to prevent slubs and marrying of the molten filaments.

51 Claims, 3 Drawing Sheets

HIGH SPEED SPINNING OF MULTI-COMPONENT FIBERS WITH HIGH HOLE SURFACE DENSITY SPINNERETTES AND HIGH VELOCITY QUENCH

BACKGROUND OF THE INVENTION

1. Field of the Invention

The present invention relates to synthetic multi-component fibers, especially synthetic bi-component fibers used in the manufacture of non-woven fabrics. In particular, the present invention relates to processes and apparatus for the production of multi-component polymer fibers and filaments at high speed and in a densely packed arrangement. More specifically, the present invention relates to multi-component fibers produced at high speed using one or more high hole surface density spinnerettes with subsequent high velocity quenching of the fibers.

2. Background Information

The production of multi-component polymer fibers typically involves the use of at least two different polymers which are routed in the molten state, via a complex spin pack, to the top hole of a spinnerette so that the desired cross-sectional configuration can be obtained for the resultant multi-component fibers which are extruded from the base of the spinnerette.

Multi-component fibers can be formed in many configurations, and the term "multi-component fibers" is used here to broadly include "bi-component fibers", where bi-component fibers include two different and separate polymeric components and multi-component fibers may have two or more different and separate polymeric components. Among the various bi-component fiber configurations are: the concentric sheath-core type, where a core is made of a first polymer and a concentric sheath made from a second polymer is disposed concentrically about the core; a side-by-side type, where two polymeric components are disposed side by side in parallel relationship in the fiber; and a tri-lobed configuration, where three tips of a tri-lobal shaped fiber are formed from a polymer which is different from a polymer that makes up the remainder of the fiber.

There are generally two types of processes used for producing multi-component fibers of the type referred to above. One process is the older two-step "long-spin" process which involves first melt-extruding fibers at typical spinning speeds of 500 to 3000 meters per minute, and more usually depending on the polymer to be spun from 500 to 1500 meters per minute, bundling the obtained unstretched fibers and temporarily storing them, and thereafter collecting them to form a thick tow which is fed through an apparatus, in a second step, usually run at 100 to 250 meters per minute, where the fibers are drawn, crimped, and cut into staple fiber.

The second process is a one-step "short spin" process which involves conversion from polymers to staple fibers in a single step where typical spinning speeds are in the range of 50 up to 200 meters per minute. The productivity of the one-step process is increased with the use of a much higher number of holes per spinnerette compared to that typically used in the long spin process.

Since the "short spin" process is carried out without any interruption between the spinning step and the drawing step, it is more advantageous than the "long spin" process in that higher yields can be achieved without the need for storage space for the fiber between steps, or the extra installation space needed for the "long spin" apparatus layout.

The principles of the production of molten multi-component filaments are known and are described in U.S. Pat. No. 4,738,607 to NAKAJIMA et al., which is hereby incorporated by reference in its entirety. In this patent, at least two different thermoplastic polymers are independently melted by heating to prepare independent spinning liquids, and the two liquids are separately fed under pressure to spinning holes by way of independent paths at which time, or just before which time, they are combined with each other at a predetermined ratio. The combined polymers are then extruded from the bottom holes of the spinnerette in the form of multiple multi-component fibers which must then be quenched to solidify the same.

Apparatus and methods are also known for melt spinning of polymers to obtain certain advantages in the spinning of bi-component fibers. For example, U.S. Pat. No. 4,406,850 to HILLS (HILLS '850), which is hereby incorporated by reference in its entirety, is directed to apparatus and methods for delivering a supply of different polymers to each spinning orifice in a spinnerette, while retaining a relatively high surface density of filaments per unit area of spinnerette face or surface.

HILLS '850 discloses that the most difficult type of bi-component spinning to achieve a high number of holes per unit area of spinnerette surface or high hole surface density, is the concentric sheath-core type. HILLS '850 discloses an improved spin pack design to achieve "high hole surface density" when spinning concentric sheath-core fibers. The spinnerette plate is disclosed to achieve a hole surface density of 2.0 to 2.5 passages per square centimeter of spinnerette bottom surface, and HILLS '850 states that even closer spacing is possible.

U.S. Pat. No. 5,162,074 to HILLS (HILLS '074), which is hereby incorporated by reference in its entirety, is directed to apparatus and methods for spinning multi-component fibers at an even higher hole surface density. HILLS '074 discloses a hole surface density of about eight or so spinning orifices in each square centimeter of spinnerette face area, and the positioning of the spinning orifices in staggered rows to promote more efficient fiber quenching. The HILLS '074 patent utilizes one or more disposable distributor plates in which distributor flow paths are etched on one or both sides to distribute different polymer components to appropriate spinnerette inlet hole locations.

In attempting to maximize productivity (i.e., grams of polymer per minute per square centimeter of spinnerette surface area) and fiber uniformity (i.e., denier and shape) while keeping costs as low as possible, HILLS '074, in several test runs, uses a spinnerette having spinning orifices (i.e., holes) arranged six millimeters apart in a direction perpendicular to the quench air flow, to produce a resulting hole surface density of 7.9 holes per square centimeter of spinnerette face area (i.e., bottom surface), or 12.6 square millimeters per hole. With this density, a strong quench air flow within the first 150 millimeters below the spinnerette was required to prevent marrying of the filaments. HILLS '074 does not specify the characteristics of the quench unit used, but makes use of a readily available and well known quench unit.

With all multi-component fiber manufacture via melt spinning there has been a problem with sufficiently quenching molten fibers which are spun at hole surface densities greater than one hole per 12.6 square millimeters of spinnerette lower surface. Standard quench units are incapable of sufficiently cooling molten multi-component filaments, and this results in "married" filaments wherein two or more filaments fuse together before they become sufficiently solidified. Another problem which results from insufficient cooling is "slubbing" wherein the molten filaments (i.e., fibers) are not cooled rapidly enough to withstand the spinning stress, which results in broken fibers or filaments.

SUMMARY OF THE INVENTION

It is an object of the present invention to achieve high production of multi-component fibers via high speed spinning through one or more high hole surface density spinnerettes, and to sufficiently quench the array of multi-component fibers extruded from the one or more high hole surface density spinnerettes at high speed, using an improved, high velocity quench unit. Hole surface density is defined as the number of surface holes per unit area of the face (i.e., bottom surface) of a spinnerette.

It is also an object of the present invention to prevent marrying and/or slubbing of the multi-component fibers which are extruded through the one or more high hole surface density spinnerettes at high speed.

Further, it is an object of the present invention to spin fibers which are uniform in cross-section over the length of the fibers produced, while meeting the other objectives of the present invention.

The objects of the present invention can be obtained by providing a process for high speed spinning of multi-component polymer filaments, comprising feeding a first polymeric component at a first melt temperature into at least one spin pack assembly; feeding a second polymeric component at a second melt temperature into the at least one spin pack assembly; combining the first and second polymeric components into a multi-component configuration and extruding through at least one high hole surface density spinnerette to form molten multi-component filaments; and quenching the molten multi-component filaments by blowing a fluid (preferably air) at a high velocity across the direction of extrusion of the multi-component molten filaments.

Preferably, the step of quenching the molten multi-component filaments by blowing a fluid at a high velocity comprises blowing a fluid at a face velocity of at least 1000 feet per minute, and a preferred range of from about 1000 feet per minute to 1600 feet per minute. More preferably, the step of quenching the molten multi-component filaments by blowing a fluid at a high velocity comprises blowing a fluid at a face velocity of at least about 1200 feet per minute. A preferred maximum face velocity is no greater than about 1400 feet per minute. In a preferred arrangement, the step of quenching the molten multi-component filaments by blowing a fluid at a high velocity comprises blowing a fluid at a face velocity of about 1300 feet per minute.

Further, the process step of quenching the molten multi-component filaments by blowing a fluid at a high velocity is preferably performed by a quench unit having an opening through which the fluid is blown, the opening being at least as wide as a combined width of the molten multi-component filaments extruded from one of the high hole surface density spinnerettes, and having a variable height. The opening of the quench unit preferably comprises a height of up to about 50 mm.

Preferably, the opening of the quench unit is set at a height of at least about 20 mm during quenching. A preferred maximum height setting is no greater than about 40 mm. In a preferred arrangement, the opening of the quench unit comprises a height of about 35 mm.

Preferably, the quench unit is positioned at a horizontal distance of at least about 4.5 centimeters from the nearest molten multi-component filament, measured from a center of the opening of the quench unit face. Preferably, the quench unit is positioned at a horizontal distance of no greater than about 5.5 centimeters from the nearest molten multi-component filament, measured from a center of the opening of the quench unit face. In a preferred arrangement, the opening of the quench unit is positioned at a horizontal distance of about 5 centimeters.

Preferably, the quench unit is positioned at a vertical distance of from about 0.0 to 20.0 centimeters from a bottom edge of the at least one high hole surface density spinnerette to a top edge of the opening. More preferably, the vertical distance comprises at least about 1.0 centimeter. A preferred maximum vertical distance comprises no greater than about 10.0 centimeters. In a preferred arrangement, the opening of the quench unit is positioned at a vertical distance of about 5.0 centimeters from the bottom surface of the at least one high hole surface density spinnerette.

In another preferred embodiment, the quench unit is positioned at a vertical distance of about 1.0 centimeter from the bottom surface of the at least one high hole surface density spinnerette.

Preferably, the quench unit is positioned at an angle of about 0 to 50 degrees with respect to horizontal, with the opening being directed toward a center of a bottom surface of the at least one high hole surface density spinnerette. More preferably, the positioning angle comprises at least about 10 degrees. A preferred maximum angle is no greater than about 35 degrees. In a preferred embodiment, the positioning angle is set at about 23 degrees.

Preferably, the quench unit blows a fluid at a high velocity through the above-defined opening at a temperature of from about 50 to 90 degrees Fahrenheit. More preferably, the fluid temperature comprises at least about 60 degrees Fahrenheit. A preferred maximum fluid temperature comprises no greater than about 80 degrees Fahrenheit. In a preferred embodiment, the temperature of the fluid which is blown at high velocity by the high velocity quench unit is about 70 degrees Fahrenheit.

Preferably, the multi-component molten filaments are produced at a spinning speed of at least about 30 meters per minute, and a preferred range of from about 30 meters per minute to 900 meters per minute. More preferably, the spinning speed comprises at least about 60 meters per minute. More preferably, the spinning speed comprises no greater than about 450 meters per minute. In a preferred embodiment, the spinning speed comprises at least about 90 meters per minute. In another preferred embodiment, the spinning speed comprises no greater than 225 meters per minute. Even more preferably, the spinning speed comprises at least about 100 meters per minute. Even more preferably, the maximum spinning speed comprises no greater than about 165 meters per minute.

Preferably, the at least one high hole surface density spinnerette comprises a bottom surface through which the molten multi-component fibers are extruded, wherein the bottom surface comprises at least one hole per 8 square millimeters of the bottom surface. More preferably, the at least one high hole surface density spinnerette comprises at least one hole per 5 square millimeters of bottom surface. A preferred embodiment of the present invention employs at least one high hole surface density spinnerette comprising at least one hole per 2.5 square millimeters of bottom surface or face. Optionally, the at least one high hole surface density spinnerette may comprise at least one hole per 0.6 square millimeters of the bottom surface.

The multi-component molten filaments can contain varying numbers of components, such as two, three, four, etc., and these components can be present in various amounts. For example, one of the components can comprise at least 10 percent, 30 percent or 50 percent of the total weight of the multi-component molten filaments. Preferably, the multi-component molten filaments produced comprise about 10 to 90 percent by weight of the first component and about 90 to 10 percent by weight of the second component. More preferably, the multi-component molten filaments comprise about 30 to 70 percent by weight of the first component and about 70 to 30 percent by weight of the second component. A preferred embodiment produces multi-component molten filaments comprising about 50 percent by weight of the first component and about 50 percent by weight of the second component.

Preferably, the process comprises an extrusion rate of the first polymeric component of from about 0.01 to 0.12 grams per minute per spinnerette hole and the extrusion rate of the second polymeric component comprises about 0.01 to 0.12 grams per minute per spinnerette hole. More preferably, the extrusion rate of the first polymeric component comprises at least about 0.02 grams per minute per spinnerette hole and the extrusion rate of the second polymeric component comprises at least about 0.02 grams per minute per spinnerette hole. More preferably, the maximum extrusion rate of the first polymeric component comprises no greater than about 0.06 grams per minute per spinnerette hole and the maximum extrusion rate of the second polymeric component comprises no greater than about 0.06 grams per minute per spinnerette hole. In a preferred embodiment, the extrusion rate of the first polymeric component is about 0.02 grams per minute per spinnerette hole and the extrusion rate of the second polymeric component is about 0.02 grams per minute per spinnerette hole.

In another preferred embodiment, the extrusion rate of the first polymeric component is about 0.06 grams per minute per spinnerette hole and the extrusion rate of the second polymeric component is about 0.06 grams per minute per spinnerette hole.

Optionally, the process further comprises the step of feeding at least a third polymeric component at a third melt temperature into the at least one spin pack assembly for combination with the first and second polymeric components to form molten multi-component fibers.

The objects of the present invention are also obtainable by providing apparatus for high speed spinning of multi-component polymer filaments, and, in particular, apparatus for performing the processes of the present invention.

Therefore, according to one embodiment of the present invention, apparatus is provided for high speed spinning of multi-component polymer filaments, comprising at least one high hole surface density spinnerette; at least one feeding element for feeding a first polymer composition through the at least one high hole surface density spinnerette, and at least one feeding element for feeding a second polymer composition through the at least one high hole surface density spinnerette, to extrude an array of molten multi-component filaments; and at least one quench unit for quenching the arrangement of molten multi-component filaments, as the molten multi-component filaments exit the at least one high hole surface density spinnerette, to effectively prevent slubs and marrying of the multi-component filaments.

Preferably, the at least one quench unit comprises a face having an opening through which the at least one quench unit blows a fluid at a high face velocity, and the face has a fixed width and a variable height. Preferably, the height is variable up to about 50 mm. Preferably, the variable height is set, in use, to at least about 20 mm. Preferably, the variable height is set, in use, to no greater than about 40 mm. In a preferred embodiment, the variable height of the face of the at least one quench unit is set at about 35 mm.

Preferably, the fixed width of the at least one quench unit face is at least as wide as a combined width of the molten multi-component fibers extruded from the at least one high hole surface density spinnerette. In a preferred embodiment, the fixed width is at least about 21 inches. In another preferred embodiment, the fixed width is at least about 23 inches.

Preferably, the at least one quench unit comprises a driving element for blowing a fluid through the face of the quench unit at a face velocity of at least about 110 feet per minute, and a preferred range of from about 1000 feet per minute to 1600 feet per minute. More preferably, the driving element blows a fluid through the face at a face velocity of at least about 1200 feet per minute. It is preferred that the driving element blows a fluid through the face at a face velocity of no greater than about 1400 feet per minute. In a preferred embodiment, the driving element blows a fluid through the face at a face velocity of about 1300 feet per minute. Preferably, the driving element blows a fluid through the face at a volumetric rate of about 300 cubic feet per minute.

The apparatus preferably comprises at least one angular mounting element for angularly mounting the at least one quench unit with respect to the at least one high hole surface density spinnerette, for directing high velocity fluid toward the bottom of the at least one high hole surface density spinnerette at an angle of from about 0 to 50 degrees. More preferably, the at least one angular mounting element mounts the at least one quench unit at an angle of at least about 10 degrees with respect to the bottom surface of the at least one high hole surface density spinnerette. It is preferred that the at least one angular mounting element mounts the at least one quench unit at an angle of no greater than about 35 degrees with respect to the bottom surface of the at least one high hole surface density spinnerette. In a preferred embodiment, the at least one angular mounting element mounts the at least one quench unit at an angle of about 23 degrees with respect to the bottom surface of the at least one high hole surface density spinnerette.

Preferably, the apparatus further comprises at least one vertical mounting element for vertically adjustably mounting the at least one quench unit with respect to the at least one high hole surface density spinnerette, such that the edge of the face of the at least one quench unit nearest the bottom surface of the at least one high hole surface density spinnerette is at a vertical distance of from about 0.0 to 20.0 centimeters measured from the bottom surface to the top edge. Preferably, the vertical mounting element mounts the at least one quench unit such that the vertical distance between the bottom surface of the spinnerette and the nearest edge of the face comprises at least about 1.0 cm. Preferably, the vertical mounting element mounts the at least one quench unit such that the vertical distance between the bottom surface of the spinnerette and the nearest edge of the face comprises no greater than about 20.0 cm. More preferably, the vertical distance comprises no greater than about 10.0 cm. In a preferred embodiment, the vertical distance is about 5.0 centimeters. In another preferred embodiment, the vertical distance is about 1.0 centimeter.

Preferably, the apparatus further comprises at least one horizontal mounting element for horizontally adjustably mounting the at least one quench unit with respect to the molten multi-component filaments as they are extruded from the at least one high hole surface density spinnerette, wherein the at least one horizontal mounting element mounts the at least one quench unit at a horizontal distance of at least about 4.5 centimeters measured from a nearest molten multi-component filament to a center of the face. Preferably, the horizontal distance comprises no greater than about 5.5 centimeters. In a preferred embodiment, the horizontal distance is set at about 5 centimeters.

The at least one high hole surface density spinnerette comprises a bottom surface through which the molten multi-component fibers are extruded, and preferably comprises at least one hole per 8 square millimeters of the bottom surface. More preferably, the at least one high hole surface density spinnerette comprises at least one hole per 5 square millimeters of the bottom surface. A preferred embodiment of the apparatus includes at least one high hole surface density spinnerette which comprises at least one hole per 2.5 square millimeters of bottom surface. Optionally, the apparatus may include at least one high hole surface density spinnerette which comprises at least one hole per 0.6 square millimeters of the bottom surface.

BRIEF DESCRIPTION OF THE DRAWINGS

The invention will be better understood and characteristics thereof are illustrated in the annexed drawings showing non-limiting embodiments of the invention, in which.

DETAILED DESCRIPTION OF THE PREFERRED EMBODIMENTS

Figure 1:
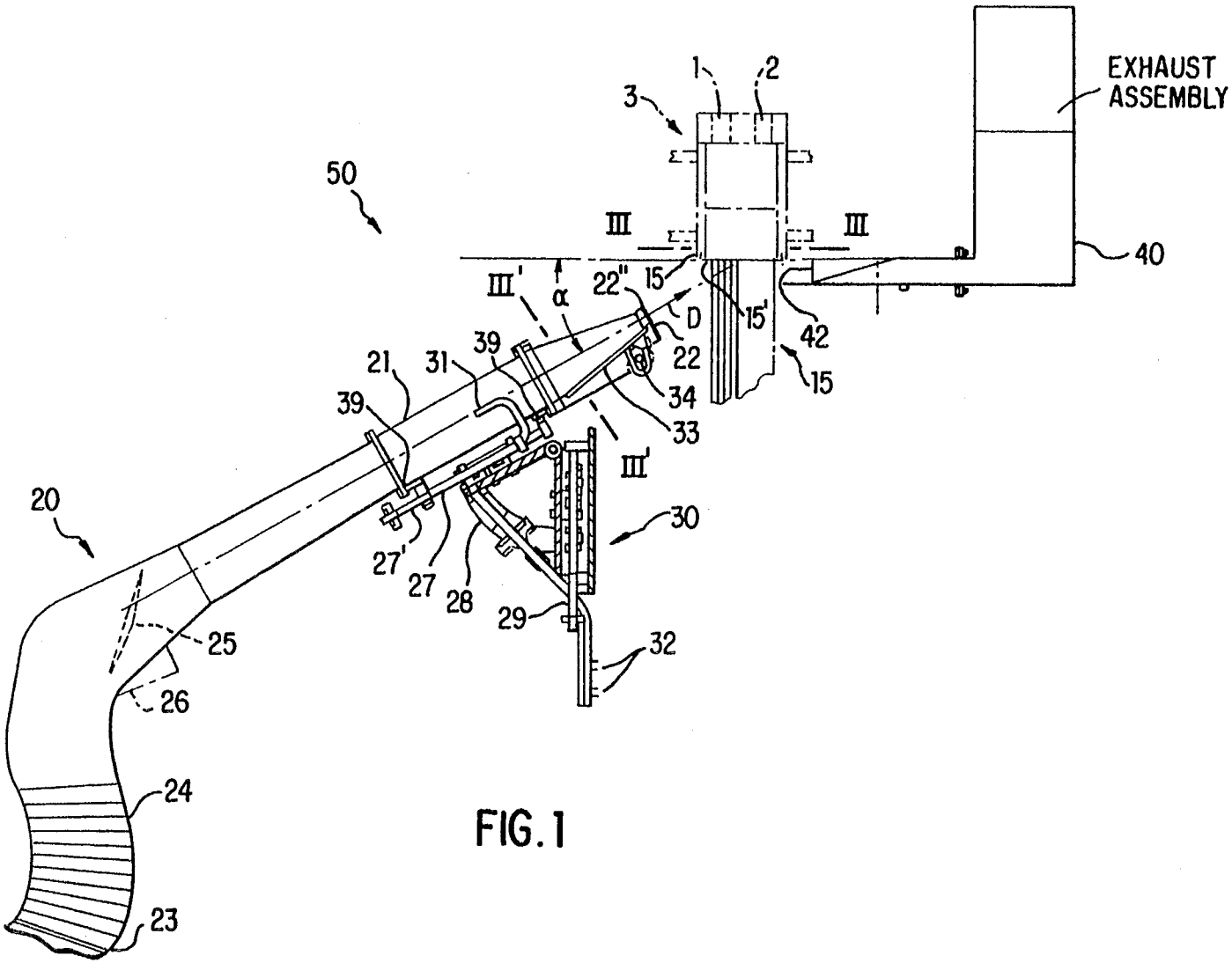
FIG. 1 illustrates a schematic view of an embodiment of an apparatus for high speed spinning of multi-component fibers including high velocity quenching according to the present invention.

In making fibers, if a substantial drop in the number of filaments per spinnerette is tolerated, much less fiber production will be achieved per spinning station, greatly increasing the capital cost to obtain a given level of fiber production. This results in a requirement for more spinning stations, each of which requires polymer pumps, pump drives, temperature control means, polymer piping, quenching facilities, takeoff rolls and building space for housing the equipment. Accordingly, even small improvements in the number of filaments extruded per spinnerette are important in terms of ultimate product cost.

A number of patent applications have been filed by the present assignee which are directed to improvements in polymer spin and quench steps. Application Ser. Nos. 08/003,696, 07/943,190 and 07/818,772 to Gupta et al., the disclosures of which are hereby incorporated by reference in their entireties, are directed to processes for spinning polypropylene fibers, and the resulting fibers and products made from such fibers. The processes of the Gupta et al. applications include melt spinning a polypropylene composition having a broad molecular weight distribution through a spinnerette to form molten fibers, and quenching the molten fibers to obtain thermally bondable polypropylene fibers. The processes of the Gupta et al. applications can be used in both a two step "long spin" process, as well as in a one step "short spin" process. The productivity of the one-step process is increased with the use of about 5 to 20 times the number of capillaries in the spinnerette compared to that typically used in the long spin process. For example, spinnerettes for a typical commercial "long spin" process would include approximately 50–4,000, preferably approximately 3,000–3,500 capillaries in one preferred arrangement and approximately 1,000–1,500 in another preferred arrangement, and spinnerettes for a typical commercial "short spin" process would include approximately 500 to 100,000 capillaries preferably, about 30,000–70,000 capillaries. Typical temperatures for extrusion of the spin melt in these processes are about 250°–325° C. Moreover, for processes wherein bi-component filaments are being produced, the numbers of capillaries refers to the number of filaments being extruded, but not necessarily the number of capillaries in the spinnerette.

To accomplish the objectives of obtaining multi-component fibers at high speed, preferably in a short spin process, the present invention provides a sufficient quenching stream to the extruded polymeric fibers in the vicinity of extrusion from the spinnerette. For example, because the standard quenching mechanisms do not adequately quench multi-component fibers extruded through at least one high hole surface density spinnerette in a short spin process, problems such as married filaments and slubbing of filaments ensue when the surface density of holes in the spinnerette(s) from which the fibers are extruded exceeds the hole surface density of a spinnerette having about one hole per 12.6 square millimeters of bottom surface area.

As used herein, the term "high hole surface density" as it applies to spinnerettes, and the term "high hole surface density spinnerette" are used in reference to spinnerettes having a hole surface density of at least one hole per 12 $mm^2$ of bottom surface of spinnerette. The terms "high velocity" and "high face velocity" are used herein to apply to quench units having a face velocity of at least 800 ft/min.

In particular, in preferred embodiments of the present invention, various characteristics are associated with the quench unit so as to provide a sufficient quench stream to the extruded multi-component fibers to solidify the fibers to an extent which will prevent, inter alia, marrying of fibers and slubbing of fibers.

The present invention is directed to various forms of fibers, including filaments and staple fibers. These terms are used in their ordinary commercial meanings. Typically, herein, filament is used to refer to the continuous fiber on the spinning machine; however, as a matter of convenience, the terms fiber and filament are also used interchangeably herein. "Staple fiber" is used to refer to cut fibers or filaments. Preferably, for instance, staple fibers for non-woven fabrics useful in diapers have lengths of about 1 to 3 inches, more preferably 1.25 to 2 inches.

The polymer materials extruded into multi-component filaments according to the present invention, can comprise any polymers that can be extruded in a long spin or short spin process to directly produce the multi-component filaments in known, lower hole surface density processes of production of multi-component filaments, such as polyolefins, polyesters, polyamides, polyvinyl acetates, polyvinyl alcohol and ethylene acrylic acid copolymers. For example, polyolefins can comprise polyethylenes, polypropylenes, polybutenes, and poly 4-methyl-1-pentenes; polyamides can comprise various Nylons, and polyvinyl acetates can comprise ethylene vinyl acetates.

A preferred polymer composition to be extruded is a polymer mixture for the production of bi-component fibers in a sheath-core configuration wherein the core is polypropylene and the sheath is polyethylene. Another preferred composition to be extruded for the production of bi-component fibers is a polymer mixture for a core-sheath configuration in which the core is polyester and the sheath is ethylene vinyl acetate.

Although the preferred embodiments are directed to bi-component fibers, the invention is not to be so limited, and applies to multi-component fibers having three or more polymeric components. Similarly, although the preferred configuration is a core-sheath configuration, the invention is not to be limited to this configuration, and applies to any multi-component configuration, including the above-mentioned configurations.

The polymeric compositions to be extruded can comprise polymers having a narrow molecular weight distribution or a broad molecular weight distribution, with a broad molecular weight distribution being preferred for polypropylene.

Further, as used herein, the term polymer includes homopolymers, various polymers, such as copolymers and terpolymers, and mixtures (including blends and alloys produced by mixing separate batches or forming a blend in situ). For example, the polymer can comprise copolymers of olefins, such as propylene, and these copolymers can contain various components, such as those discussed in the above-mentioned applications to Gupta et al., for example.

The melt flow index (MFI) as described herein is determined according to ASTM D1238-82 (condition L for polypropylene and condition E for polyethylene. Other polymers are run under different conditions which are listed in the aforementioned recommended procedure).

By practicing the process of the present invention, and by spinning polymer compositions using melt spin processes, such as a long spin or short spin process according to the present invention, fibers and filaments can be obtained which have excellent uniformity and can be produced using one or more high hole surface density spinnerettes for excellent productivity resulting in reduced cost of production.

For example, for a typical short spin process for the extrusion of sheath-core fibers having polypropylene cores and polyethylene sheaths, with the core component being polypropylene and the sheath component being polyethylene, the polypropylene being extruded at a melt temperature of about 250° C. and the polyethylene being extruded at a melt temperature of about 230° C., the two polymer streams were transferred through a spin beam jacketed with Dowtherm at 260° C. and into a spin pack. The spin pack maintained the polymers as separate melt streams until just before the spinnerette where they were combined in a sheath-core configuration. If a spinnerette having, for example, 15,744 holes of 0.012 inch diameter with 2:1 L/D ratio arranged in a rectangular pattern with a hole density of one hole per 2.5 $mm^2$ is used, and the polymers are spun in a 50:50 ratio of core component to sheath component, with the extrusion rate of each component being 0.021 gm/min/hole, a standard flow quench unit is inadequate to solidify all of the fibers exiting the spinnerette before some type of failure occurs. The two most common failures which occurred using a standard flow quench unit under the above conditions were marrying, where two or more fibers would fuse together before they became sufficiently solidified; and slubbing, where one or more fibers would break under the spinning tension due to poor tensile strength caused by insufficient solidification.

Referring to FIG. 1, an apparatus is shown for high face velocity quenching of multi-component fibers which are spun at high speed through at least one high hole surface density spinnerette, according to the present invention. A first polymeric component is fed into first inlet port 1 and a second polymeric component is fed into inlet port 2 of spin pack 3, the first and second components being fed from separate metering pumps. The spin pack 3 shown in FIG. 1 is for use in making bi-component fibers. Optionally, a spin pack having a third inlet for processing a third polymeric component could be used for producing tri-component fibers. Additionally, spin packs which accept more than three polymeric components for more complex multi-component fiber production can be used.

Figure 4:
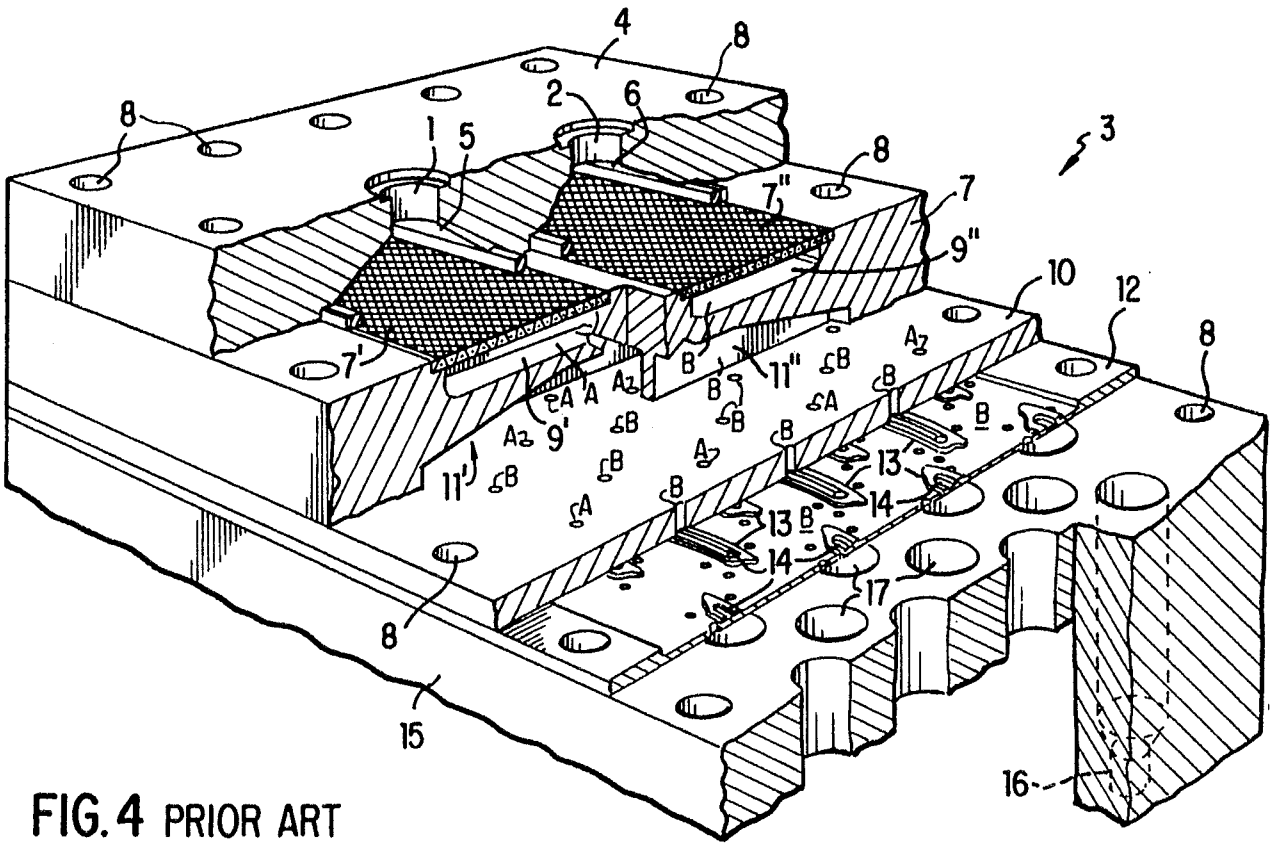
FIG. 4 PRIOR ART
FIG. 4 illustrates a spinnerette for providing the multi-component fibers according to the present invention.

Referring to FIG. 4, a more detailed perspective view of a known spin pack (such as one disclosed in HILLS '074, referred to above) which can be used in the apparatus of FIG. 1 is shown. First and second inlet ports 1,2 lead through top plate 4 and deliver the respective polymeric components to tent-shaped cavities 5,6, respectively. Screen support plate 7 holds screens 7' and 7'' for filtering the polymeric components flowing out from the cavities 5 and 6, respectively. Below the screens 7' and 7'' are a series of side-by-side recessed slots 9' and 9''. An array of flow distribution apertures A (for the first polymeric component) and B (for the second polymeric component) is arranged in plate 10. Slots 11' and 11'' are aligned with apertures A and B, respectively to separately deliver the first and second polymeric components to respective apertures.

A distributor plate 12 is disposed immediately beneath (i.e., downstream of) plate 10. Distributor plate 12 includes a regular pattern of individual dams 13, with each dam 13 being positioned to receive a respective branch of the first flowing polymeric component through a respective metering aperture A. At both ends of each dam 13, there is a distribution aperture 14. Dams 13 and distribution apertures 14 are preferably etched (most preferably, by photo-chemical etching) into distribution plate 12, with dams 13 being etched on the upstream side of plate 12 and apertures 14 being etched from the downstream side of distribution plate 12. However, distribution plate 12 can also be formed by other methods such as drilling, reaming, and other forms of machining and cutting. The distribution plate shown is for illustrative purposes only. The number and types of distribution plates is determined by the complexity of the polymer component distribution desired for each fiber.

The upstream surface area of distribution plate 12 which does not contain the dams 13 is etched or otherwise machined to a prescribed depth to receive the second polymeric component from metering apertures B. Spinnerette plate 15 is provided with an array of spinning holes 16 extending entirely through its thickness. Each spinning hole 16 has a counterbore 17 which forms an inlet hole at the upstream side of the spinnerette plate 15. The first and second polymer components are first brought together into the desired configuration at the inlet hole 17, and fibers having the desired multi-component configuration are extruded from spinning holes 16.

Figure 5:
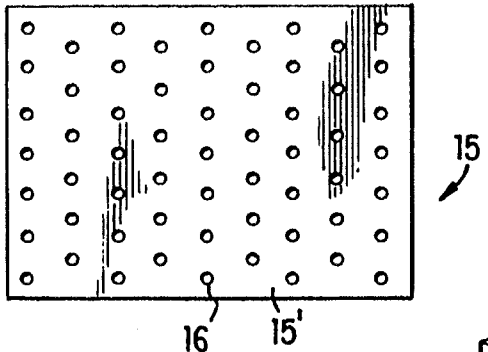
FIG. 5 PRIOR ART
FIG. 5 schematically illustrates a bottom face of a spinnerette for providing the multi-component fibers according to the present invention.

FIG. 5 is a schematic of a view of a bottom surface (i.e., face) of a spinnerette such as the one shown in FIG. 4, when viewed from the bottom up. The spinning holes 16 are arranged in staggered rows to improve quenching efficiency. For increased productivity, it is desirable to form spinning holes 16 in as dense a pattern as possible. The density achievable is limited by geometrical constraints which govern how close the components can be placed next to one another without interfering with each other. In this regard, standard hole surface density spinnerettes have a hole surface density of up to about one spinning hole per 12.6 $mm^2$ of spinnerette face (i.e., bottom surface) area. High hole surface density spinnerettes include, for example, spinnerettes having hole surface densities of one hole per 8 $mm^2$. Spinnerettes having hole surface densities up to one hole per 2.5 $mm^2$ have been designed for the production of multi-component fibers and hole surface densities of up to one hole per 0.6 $mm^2$ have been possible for single component fibers.

When using the high hole surface density spinnerettes for production of multi-component fibers, a standard quench system was found to be undesirable and did not adequately solidify the fibers extruded from the high hole surface density spinnerette, which resulted in slubs and/or married filaments. The standard quench system included a standard rectangular cross blow box faced with a foam pad 35 inches long and 25 inches wide, and arranged to give a constant velocity profile of 330 ft/min along the entire length of the face.

Referring back to FIG. 1, an apparatus is shown which uses an improved quench system according to the present invention. For example, first and second polymers are dry blended separately, with respective additives in a continuous process and each of the first and second polymer blends is fed to a separate reservoir directly above a feed throat of an extruder (not shown). Each of the first and second polymer blends is fed through a separate extruder (not shown) and extruded as first and second molten polymer components, respectively.

The first molten polymeric component is introduced into spin pack 3 through inlet port 1 at a first melt temperature and a second molten polymeric component is introduced through inlet port 2 at a second melt temperature. Although FIG. 1 illustrates only one spin pack 3, the invention is not to be so limited, and may include two or more spin packs for parallel processing of multi-component filaments. When polypropylene and polyethylene are used as the polymeric components, the melt temperatures are maintained at about 250° C. and 230° C., respectively.

The molten polymeric components are processed by the spin pack 3 as described previously and a densely packed array of multi-component molten fibers are extruded from spinning holes 16 at the bottom surface of spinnerette 15. The components may be combined into multi-component fibers at a ratio of from about 10 to 90 percent by weight of first component to about 90 to 10 percent by weight of second component. Preferably, the ratio is from about 30 to 70 percent by weight of first component to about 70 to 30 percent by weight of second component. A preferred sheath-core embodiment comprises a ratio of about 50 percent by weight of first component to about 50 percent by weight of second component.

The spinning speed or speed at which the multi-component fibers are taken up from the spinning holes may range from about 30 m/min to 900 m/min. More preferably, the spinning speed comprises at least about 60 meters per minute. More preferably, the spinning speed comprises no greater than about 450 meters per minute. In a preferred embodiment, the spinning speed comprises at least about 90 meters per minute. In another preferred embodiment, the spinning speed comprises no greater than 225 meters per minute. Even more preferably, the spinning speed comprises at least about 100 meters per minute. Even more preferably, the maximum spinning speed comprises no greater than about 165 meters per minute.

The rate of extrusion of the multi-component fibers from the spinning holes 16 is from about 0.01 to 0.12 gm/min per spinnerette hole for each component when the components are combined at about a 50:50 ratio by weight. In preferred embodiments, the preferred minimum extrusion rate for each component is about 0.02 gm/min per spinnerette hole when the components are combined at about a 50:50 ratio by weight. In preferred embodiments, the preferred maximum extrusion rate for each component is about 0.06 gm/min per spinnerette hole when the components are combined at about a 50:50 ratio by weight.

Upon extrusion from the spinning holes 16, the multi-component fibers 18 are immediately quenched by high face velocity fluid exiting from the face 22 of quench nozzle 21. The temperature of the fluid exiting from the face 22 is about 50° F. to 90° F. A preferred minimum quench fluid temperature at the face 22 is about 60° F. A preferred maximum quench fluid temperature at the face 22 is about 80° F. In a preferred example, the quench fluid temperature at the face 22 is about 70° F.

Spin finish is applied by a kiss roll (not shown) after the filaments have solidified. The filaments are drawn between septets (not shown) into a tow and the tow is preheated before entering a stuffer box type crimper (not shown) in which the filaments are crimped. The filaments are next air cooled on a conveyor (not shown) and overfinish is applied through slot bars (not shown). Alternatively, overfinish can be applied in spray form on the tow after it exits the crimper. Finally, the filaments are cut into staple fibers and baled.

The quench system 20 shown in FIG. 1 is a preferred embodiment of the instant invention. However, more than one of the quench units may be employed for batch processing and other equivalent configurations may be used for achieving the desired results. Quench unit 20 includes at least one driving element 23 for blowing a controlled fluid flow through flexible duct 24 into quench nozzle 21 and finally through the face 22 of the quench nozzle where the fluid flow is directed into the array of molten multi-component fibers or filaments 18 to quench the same. The preferred quench fluid is air, but other fluids, such as inert gases, for example, may be used instead of, or combined with air. A standard exhaust assembly 40 having a gated opening 42 is provided for removing the quench fluid as it passes through and around the array of multi-filaments 18.

The at least one driving element 23 is preferably a centrifugal fan which overfeeds the system, but other equivalents may be used, e.g., a turbine, etc. Flow control element 25 controls the amount of fluid which is inputted to quench nozzle 21. Preferably, the flow control element 25 is a butterfly valve, but other equivalent valve means may be used in place of a butterfly valve. Waste gate 26 (shown in the open position in phantom) disposes of any excess fluid which is supplied by the driving element 23.

Nozzle 21 is mounted to apparatus 50 via horizontal mounting element 27, angular mounting element 28 and vertical mounting element 29, all of which are interconnected as mounting unit 30 and to which nozzle 21 is fixed by mounts 39. Pitot tube 31 measures the pressure of fluid passing through nozzle 21. Mounting unit 30 is fixed to apparatus 50 at 32 via bolts, screw, welds or other equivalent anchoring means. Horizontal mounting element 27 is adjustable via adjustment element 27' which is preferably a screw drive but may be a turnbuckle arrangement, rack and pinion arrangement or other equivalent biasing mechanism. Adjustment of the horizontal mounting element 27 moves the face 22 nearer or further away from the array of extruded molten filaments 18. The horizontal distance of the face 22 from the molten filaments 18 is measured from the molten fiber nearest the center of face 22' to the center of the face 22'. The nozzle is movable from a horizontal distance of about 0.0 up to about 10 cm. A preferred minimum horizontal distance for high face velocity quenching is about 4.5 cm. A preferred maximum horizontal distance for high face velocity quenching is about 5.5 cm. In a preferred embodiment, a horizontal distance of about 5 cm is set.

Adjustment of the vertical mounting element 29 moves the face 22 nearer or further away from the bottom surface (or face) 15' of spinnerette 15. The vertical distance of the face 22 from the bottom surface 15' is measured from the height of the top edge 22'' of the face 22 to the height of the bottom surface 15' of the spinnerette. The nozzle is movable from a vertical distance of about 0.0 up to about 10 cm. A preferred minimum vertical distance for high face velocity quenching is about 0.0 cm. A preferred maximum vertical distance for high face velocity quenching is about 6.0 cm, with a vertical distance of about 5.0 cm being one of the most preferred settings, and a vertical distance of about 1.0 cm being another of the most preferred settings.

Adjustment of the angular mounting element 28 varies the angle $\alpha$ between the direction in which the quench nozzle directs a quench fluid stream D and the horizontal direction of the spinnerette lower surface 15'. The angular range of the angular mounting element is from about 0 degrees (i.e., quench stream substantially parallel to lower spinnerette surface and perpendicular to direction of extrusion) to about 50 degrees. A preferred minimum angle is about 10 degrees. A preferred maximum angle is about 35 degrees. An angle of about 23 degrees is one of the most preferred settings.

Figure 2:
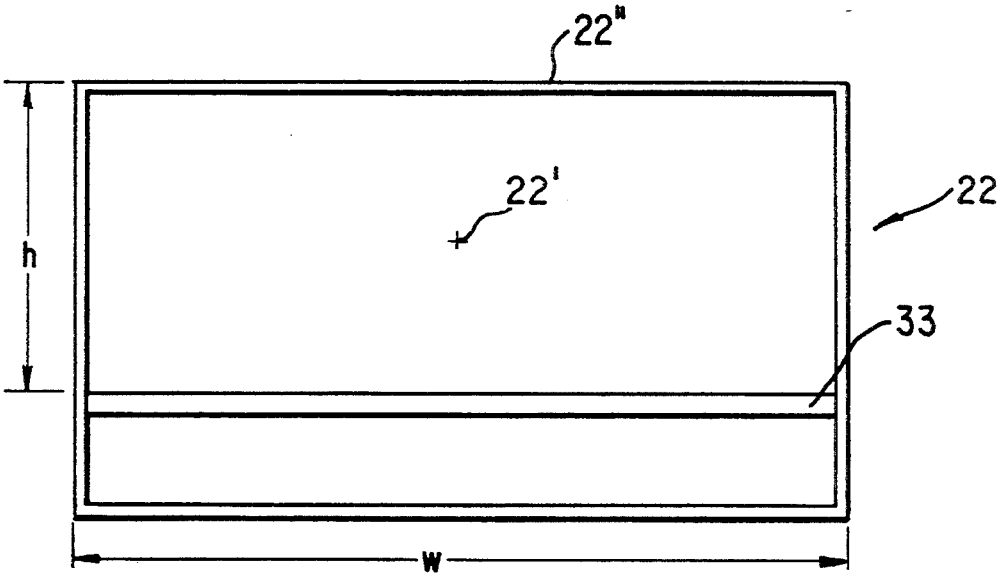
FIG. 2 illustrates a face view of the opening of a quench unit according to the present invention.

Quench nozzle 21 is provided with height varying means, which is adjustable for varying the height of the opening at the face 22 of the quench nozzle 21. Height varying means 33 is preferably a flat plate which is angularly variable by adjustment of height adjustment mechanism 34. The height adjustment mechanism is preferably a screw drive with adjustment knob, but other equivalent adjustment mechanisms may be interchangeably used. FIG. 2 shows an end view of face 22 and the effect of height varying means 33 upon the height dimension h of the face. The height h is variable by height varying means (e.g., plate) 33 up to a height of about 50 mm. Preferably, the minimum height of the face opening is set at about 20 mm. Preferably, the maximum height of the face opening is set at about 40 mm. A preferred embodiment includes a height setting of about 35 mm. Variation of the height of the face opening varies the area of the opening which is inversely proportional to the face velocity of the quench stream exiting the face.

Figure 3:
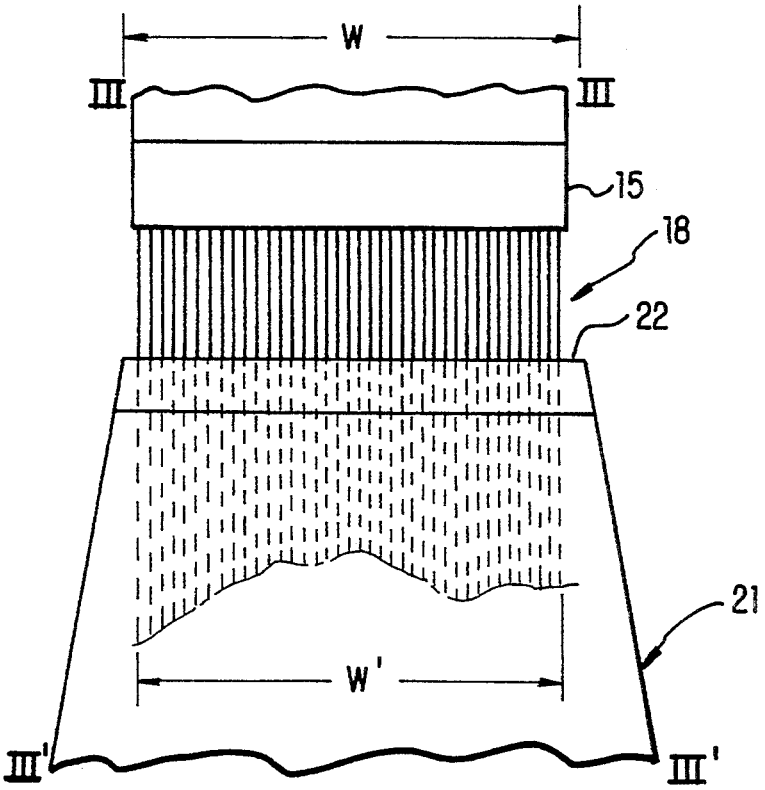
FIG. 3 illustrates a partial left side view, taken along lines III—III and III'—III', of the apparatus shown in FIG. 1.

FIG. 3 shows a left side view of a portion of the apparatus taken along lines III—III and III'—III' in FIG. 1. For effective quenching it is preferred that all of the molten multi-component filaments are subjected to the high velocity quench which is emitted from face 22. Accordingly, it is preferred that the width w of the face 22 is greater than the width w' of the array of filaments extruded from a high hole surface density spinnerette 15. In practice, the face 22 has a fixed width of at least greater than about 18 in. A preferred embodiment comprises a fixed width w of at least about 21 in. Another preferred embodiment uses a quench unit having a fixed face width of at least about 23 in.

By appropriately adjusting the face height of quench nozzle 21 and flow control means 25, the quench unit is capable of blowing a quench fluid stream through the face 22 at a face velocity of at least about 100 ft/min and preferably within a range of from about 1000 ft/min to 1600 ft/min. More preferably, a minimum face velocity is about 1200 ft/min. More preferably, a maximum face velocity is about 1400 ft/min. A preferred embodiment includes a setting of the quench unit to provide a face velocity of about 1300 ft/min. At a face velocity of about 1300 ft/min, the quench nozzle ejects fluid at a volumetric rate of about 300 $ft^3$/min.

In order to more clearly describe the present invention, the following non-limiting examples are provided. Two examples of prior art are provided (i.e., Examples 1 and 2) for purposes of comparison.

EXAMPLES

All examples share the following common characteristics:

Bi-component fibers having a sheath-core configuration were obtained by melt-spinning under the following conditions: a core component was HIMONT fiber grade polypropylene having a $MFI_{230}$ of 20 dg/min, a weight-to-number average molecular weight distribution of 4.3 as determined by size exclusion chromatography, a solid state density of 0.905 gm/cc, and a melting point peak temperature of 165° C. as determined by differential scanning calorimetry. A sheath component was Dow Aspun 6811A fiber grade polyethylene (a copolymer of ethylene and octene-1) having a $MFI_{190}$ of 27 dg/min, a solid state density of 0.9413 gm/cc, and a melting point peak temperature of 126° C.

The polypropylene was extruded at a melt temperature of about 250° C. and the polyethylene was extruded at a melt temperature of about 230° C. The two polymer streams were transferred through a spin beam jacketed with Dowtherm at 260° C. into a spin pack. The spin pack maintained the polymers as separate melt streams until just before the spinnerette where they were combined in a sheath-core configuration. The spinnerette used has 15,744 holes of 0.012 inch diameter with 2:1 L/D ratio arranged in a rectangular pattern with a hole density of 2.5 $mm^2$ per hole. The polymers were spun in a 50:50 ratio, by weight, of core component to sheath component. The extrusion rate of each component was 0.021 gm/min/hole.

Comparative Example 1

The extruded filaments were quenched by 2000 $ft^3$/min of cross blow air at 70° F. from a conventional cross-blow quench unit located just below the lower surface (face) of the spinnerette (i.e., the top edge of the conventional cross-blow quench unit was flush with the lower surface of the spinnerette). The conventional cross-blow quench unit consisted of a rectangular box faced with a foam pad 35 inches long and 25 inches wide, arranged to give a constant velocity profile along the entire length of the face equal to about 330 ft/min. An exhaust unit, having an opening 2 inches wide and 25 inches long is provided on the side of the extruded filaments opposite the side at which the quench unit was positioned. The exhaust unit was run at a static pressure of 0.9 inches of water. The filaments were taken around a free wheeling Godet roll and over a draw roll stand at 107 m/min.

Under the above conditions, suitable spinning could not be established. The quench air was inadequate to sufficiently cool the spun molten fibers before they were combined into a single tow. Accordingly, married filaments resulted, as well as slubbing.

Comparative Example 2

The quench unit used was the same as that described in Comparative Example 1. Quench air rates of 1000–3000 $ft^3$/min of cross blow air at temperatures ranging from 60° F. to 80° F. were tried in an attempt to establish suitable spinning conditions. In one test, the lower half of the quench unit was closed off to increase the air velocity to approximately 600 ft/min. None of the above combinations of conditions was capable of establishing acceptable spinning conditions as marrying and/or slubbing of filaments always resulted.

Example 3

The extruded filaments were quenched by 300 $ft^3$/min of air blown at 70° F. across the threadline through a quench unit as shown in FIG. 1. The quench unit was situated 5.0 cm below the lower surface (face) of the spinnerette. The quench unit was set to have a rectangular face opening 35 mm high by 25 inches wide and was angled at approximately 23° from horizontal and aimed towards the center of the lower surface of the spinnerette. The opening of the quench unit was situated at a horizontal distance of approximately 5 cm. The face velocity of the air through the quench unit was approximately 1300 ft/min. An exhaust unit having an opening of 2 inches by 25 inches was located on the side of the extruded filaments opposite the side nearest the quench unit. The exhaust unit was run at a static pressure of 0.9 inches of water. The filaments were taken around a free wheeling Godet roll and over a draw roll stand at 107 m/min, and the extrusion rate of each component was 0.021 gm/min/hole. Continuous spinning was satisfactory and no slubs or married filaments resulted.

Example 4

Spinning was carried out under the same conditions as in Example 3, except that the draw roll speed was 129 m/min, and the extrusion rate of each component was 0.025 gm/min/hole. Continuous spinning was satisfactory and no slubs or married filaments resulted.

Example 5

Spinning was carried out under the same conditions as in Example 3, except that the draw roll speed was 129 m/min, and the extrusion rate of each component was 0.022 gm/min/hole. Continuous spinning was satisfactory and no slubs or married filaments resulted.

Example 6

Spinning was carried out under the same conditions as in Example 3, except that the draw roll speed was 129 m/min, and the extrusion rate of each component was 0.06 gm/min/hole. Continuous spinning was satisfactory and no slubs or married filaments resulted.

Although the invention has been described with reference to particular means, materials and embodiments, it is to be understood that the invention is not limited to the particulars disclosed and extends to all equivalents within the scope of the claims.

We claim:

1. A process for high speed spinning of multi-component polymer filaments, comprising:

feeding a first polymeric component at a first melt temperature into at least one spin pack assembly;

feeding a second polymeric component at a second melt temperature into the at least one spin pack assembly;

combining the first and second polymeric components into a multi-component configuration and extruding through at least one high hole surface density spinnerette to form molten multi-component filaments; and quenching the molten multi-component filaments by blowing a fluid at a high velocity across the direction of extrusion of the multi-component molten filaments, to effectively prevent slubs and marrying of the multi-component filaments.

2. The process according to claim 1, wherein the quenching the molten multi-component filaments by blowing a fluid at a high velocity comprises blowing a fluid at a face velocity ranging from about 1000 feet per minute to 1600 feet per minute.

3. The process according to claim 1, wherein the quenching the molten multi-component filaments by blowing a fluid at a high velocity comprises blowing a fluid at a face velocity comprising at least about 1200 feet per minute.

4. The process according to claim 1, wherein the quenching the molten multi-component filaments by blowing a fluid at a high velocity comprises blowing a fluid at a face velocity comprising no greater than about 1400 feet per minute.

5. The process according to claim 2, wherein the quenching the molten multi-component filaments by blowing a fluid at a high velocity comprises blowing a fluid at a face velocity of about 1300 feet per minute.

6. The process according to claim 1, wherein the quenching the molten multi-component filaments by blowing a fluid at a high velocity is performed by a high face velocity quench unit having a face opening through which a fluid is blown, said face opening being at least as wide as a combined width of the molten multi-component filaments extruded from one of the high hole surface density spinnerettes, and having a variable height.

7. The process according to claim 6, wherein the face opening of the high face velocity quench unit comprises a height of up to about 50 mm.

8. The process according to claim 7, wherein the face opening of the high face velocity quench unit comprises a height no greater than about 40 mm.

9. The process according to claim 7, wherein the face opening of the high face velocity quench unit comprises a height of at least about 20 mm.

10. The process according to claim 8, wherein the face opening of the high face velocity quench unit comprises a height of about 35 mm.

11. The process according to claim 1, wherein the quenching the molten multi-component filaments by blowing a fluid at a high velocity is performed by a high face velocity quench unit having a face opening through which the fluid is blown, and the high face velocity quench unit is positioned at a horizontal distance of at least about 4.5 centimeters from the nearest molten multi-component filament, measured from a center of the face opening.

12. The process according to claim 1, wherein the quenching the molten multi-component filaments by blowing a fluid at a high velocity is performed by a high face velocity quench unit having a face opening through which the fluid is blown, and the high face velocity quench unit is positioned at a horizontal distance comprising no greater than about 5.5 centimeters from the nearest molten multi-component filament, measured from a center of the face opening.

13. The process according to claim 11, wherein the horizontal distance is about 5 centimeters.

14. The process according to claim 1, wherein the quenching the molten multi-component filaments by blowing a fluid at a high velocity is performed by a high face velocity quench unit having a face opening through which the fluid is blown, and the high face velocity quench unit is positioned at a vertical distance of from about 0.0 to 20.0 centimeters from a bottom edge of the at least one high hole surface density spinnerette to a top edge of the face opening.

15. The process according to claim 14, wherein the vertical distance comprises at least about 1.0 centimeter.

16. The process according to claim 14, wherein the vertical distance comprises no greater than about 10.0 centimeters.

17. The process according to claim 15, wherein the vertical distance is about 5.0 centimeters.

18. The process according to claim 15, wherein the vertical distance is about 1.0 centimeter.

19. The process according to claim 1, wherein the quenching the molten multi-component filaments by blowing a fluid at a high velocity is performed by a high face velocity quench unit having a face opening through which the fluid is blown, and the quench unit is positioned at an angle of about 0 to 50 degrees with respect to horizontal, with the face opening being directed toward a center of a bottom surface of the at least one high hole surface density spinnerette.

20. The process according to claim 19, wherein the angle comprises at least about 10 degrees.

21. The process according to claim 19, wherein the angle comprises no greater than about 35 degrees.

22. The process according to claim 20, wherein the angle is about 23 degrees.

23. The process according to claim 1, wherein the quenching the molten multi-component filaments by blowing a fluid at a high velocity is performed by a high face velocity quench unit having a face opening through which a fluid having a temperature of from about 50° to 90° F. is blown.

24. The process according to claim 23, wherein the fluid temperature comprises at least about 60° F.

25. The process according to claim 23, wherein the fluid temperature comprises no greater than about 80° F.

26. The process according to claim 24, wherein the fluid temperature is about 70° F.

27. The process according to claim 1, wherein the multi-component molten filaments are produced at a spinning speed of from about 30 meters per minute to 900 meters per minute.

28. The process according to claim 27, wherein the spinning speed comprises at least about 60 meters per minute.

29. The process according to claim 27, wherein the spinning speed comprises no greater than about 450 meters per minute.

30. The process according to claim 28, wherein the spinning speed comprises at least about 90 meters per minute.

31. The process according to claim 29, wherein the spinning speed comprises no greater than about 225 meters per minute.

32. The process according to claim 30, wherein the spinning speed comprises at least about 100 meters per minute.

33. The process according to claim 31, wherein the spinning speed comprises no greater than about 165 meters per minute.

34. The process according to claim 1, wherein the at least one high hole surface density spinnerette comprises a bottom surface through which the molten multi-component fibers are extruded, the at least one high hole surface density spinnerette further comprising at least about one hole per 8 square millimeters of the bottom surface.

35. The process according to claim 34, wherein the at least one high hole surface density spinnerette comprises at least about one hole per 5 square millimeters of the bottom surface.

36. The process according to claim 35, wherein the at least one high hole surface density spinnerette comprises at least about one hole per 2.5 square millimeters of the bottom surface.

37. The process according to claim 36, wherein the at least one high hole surface density spinnerette comprises at least about one hole per 0.6 square millimeters of the bottom surface.

38. The process according to claim 1, wherein the multi-component molten filaments comprise about 10 to 90 percent by weight of the first component and about 90 to 10 percent by weight of the second component.

39. The process according to claim 38, wherein the multi-component molten filaments comprise about 30 to 70 percent by weight of the first component and about 70 to 30 percent by weight of the second component.

40. The process according to claim 39, wherein the multi-component molten filaments comprises about 50 percent by weight of the first component and about 50 percent by weight of the second component.

41. The process according to claim 1, wherein the extrusion rate of the first polymeric component comprises from about 0.01 to 0.12 grams per minute per spinnerette hole and the extrusion rate of the second polymeric component comprises about 0.01 to 0.12 grams per minute per spinnerette hole.

42. The process according to claim 41, wherein the extrusion rate of the first polymeric component comprises at least about 0.02 grams per minute per spinnerette hole and the extrusion rate of the second polymeric component comprises at least about 0.02 grams per minute per spinnerette hole.

43. The process according to claim 41, wherein the extrusion rate of the first polymeric component comprises no greater than about 0.06 grams per minute per spinnerette hole and the extrusion rate of the second polymeric component comprises no greater than about 0.06 grams per minute per spinnerette hole to 0.06.

44. The process according to claim 43, wherein the extrusion rate of the first polymeric component is about 0.02 grams per minute per spinnerette hole and the extrusion rate of the second polymeric component is about 0.02 grams per minute per spinnerette hole.

45. The process according to claim 42, wherein the extrusion rate of the first polymeric component is about 0.06 grams per minute per spinnerette hole and the extrusion rate of the second polymeric component is about 0.06 grams per minute per spinnerette hole.

46. The process according to claim 1, further comprising the step of feeding at least a third polymeric component at a third melt temperature into the at least one spin pack assembly for combination with the first and second polymeric components to form molten multi-component fibers.

47. The process according to claim 1, wherein the quenching the molten multi-component filaments comprises immediately quenching the molten multi-component filaments as the molten multi-component filaments are extruded from the at least one high hole surface density spinnerette.

48. The process according to claim 1, wherein the step of quenching the molten multi-component filaments comprises blowing air at a high velocity across the direction of extrusion of the multi-component molten filaments.

49. The process according to claim 1, wherein the multi-component filaments are bi-component filaments.

50. The process according to claim 49, wherein each of the bi-component filaments comprises a sheath-core configuration.

51. The process according to claim 50, wherein each of the bi-component filaments comprises a polyethylene sheath and a polypropylene core.

* * * * *